United States Patent [19]

Alley et al.

[11] 4,288,773

[45] Sep. 8, 1981

[54] AMORPHOUS METAL BALLASTS AND REACTORS

[75] Inventors: Robert P. Alley, Manlius; Russell E. Tompkins, Scotia, both of N.Y.

[73] Assignee: General Electric Company, Schenectady, N.Y.

[21] Appl. No.: 966,855

[22] Filed: Dec. 6, 1978

[51] Int. Cl.[3] ..... H01F 17/06; H01F 71/08; H01F 77/24

[52] U.S. Cl. ..... 336/160; 336/83; 336/165; 336/178; 336/211

[58] Field of Search ..... 336/155, 160, 165, 178, 336/211, 83, 212; 164/260; 148/31.55; 310/114

[56] References Cited

U.S. PATENT DOCUMENTS

| | | | |
|---|---|---|---|
| 2,792,556 | 5/1957 | Oglesbee | 336/155 |
| 2,958,806 | 11/1960 | Lord | 336/165 X |
| 2,962,679 | 11/1960 | Stratton | 336/83 |
| 2,971,124 | 2/1961 | Feinberg et al. | 336/165 X |
| 3,072,826 | 1/1963 | Schwarz et al. | 336/165 X |
| 3,111,637 | 11/1963 | Ouletta | 336/178 X |
| 3,176,253 | 3/1965 | Radtke | 336/165 |
| 3,708,744 | 1/1973 | Stephens et al. | 336/155 X |
| 4,036,638 | 7/1977 | Ray et al. | 148/31.55 X |
| 4,116,728 | 9/1978 | Becker et al. | 336/213 X |
| 4,197,146 | 4/1980 | Frischmann | 148/31.55 |

*Primary Examiner*—Thomas J. Kozma

*Attorney, Agent, or Firm*—William H. Steinberg; James C. Davis, Jr.; Paul R. Webb, II

[57] ABSTRACT

A lamp ballast has a pair of adjacent gapped "O" magnetic cores made of nested, almost complete loops of amorphous metal strip with the gaps in the loops shaped and arranged under the secondary coil to simulate any type of restricted cross section for shaping the lamp current. A long slender reactor has a similar configuration in which the gaps are staggered; a different embodiment has a long central core of compressed amorphous metal flake and a helical overwrap of ribbon. An alloy of iron, boron, and silicon with a high $B_r/B_s$ ratio is preferred for these inductive devices.

6 Claims, 10 Drawing Figures

Fig. 1
(PRIOR ART)
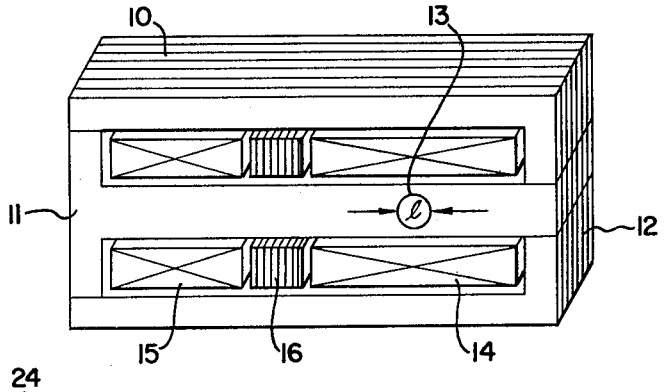
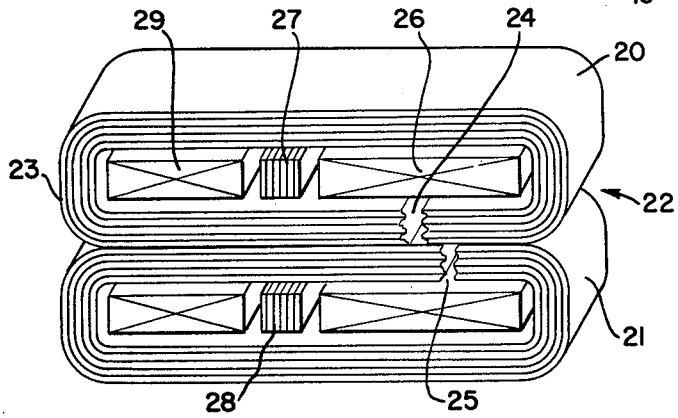
Fig. 2
Fig. 3a
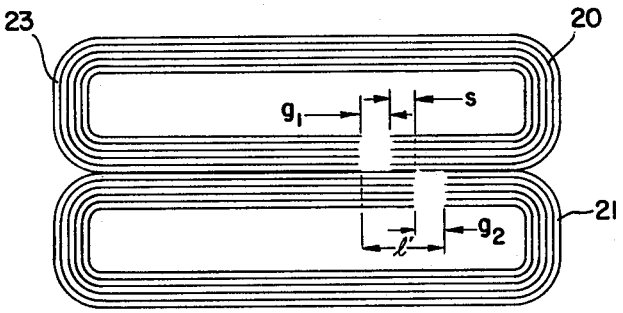
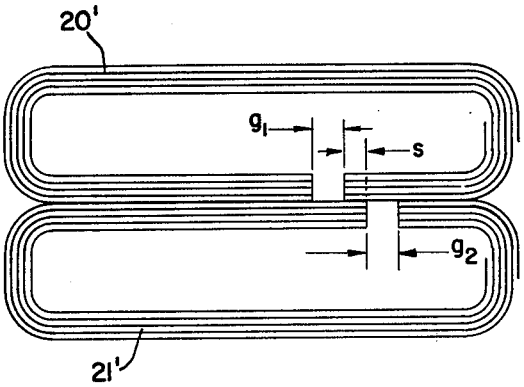
Fig. 3b
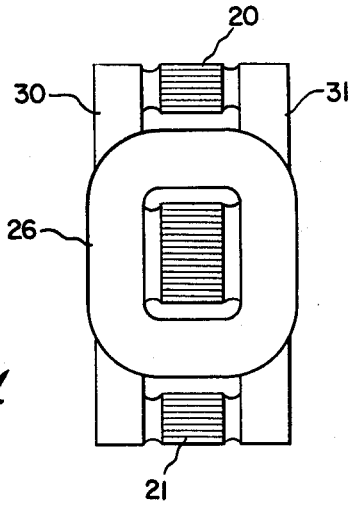
Fig. 4

Fig. 5
(PRIOR ART)
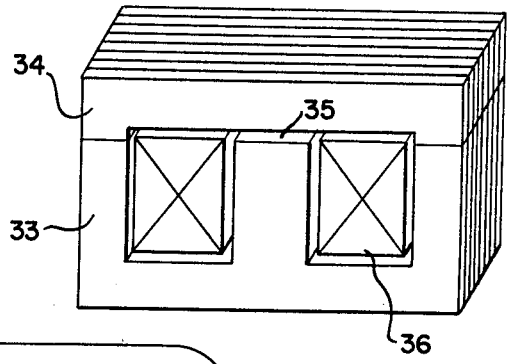
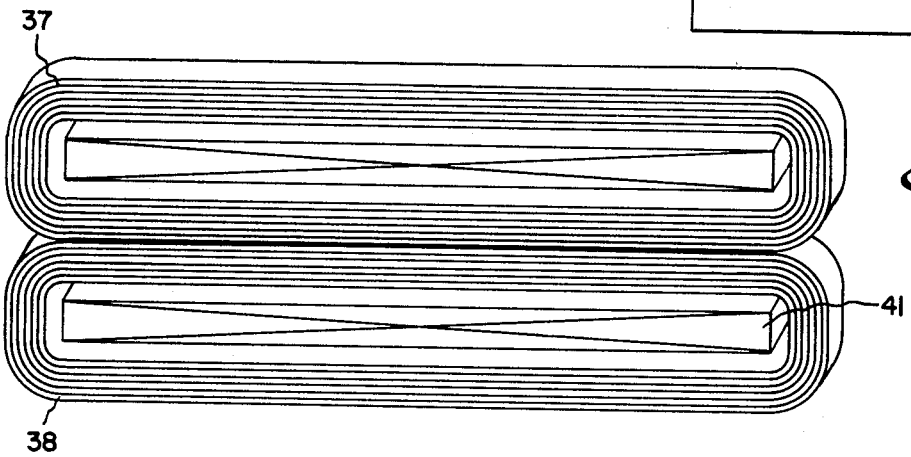
Fig. 6
Fig. 7
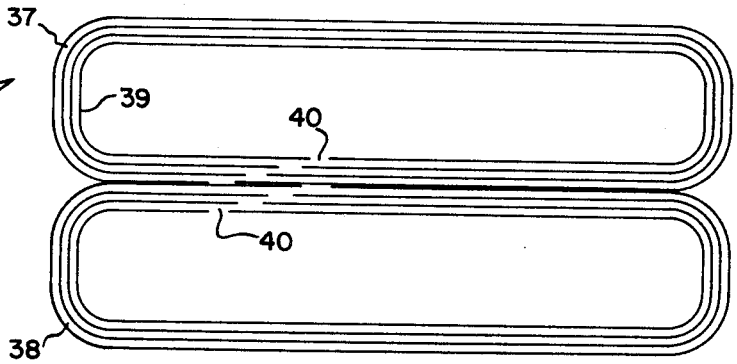
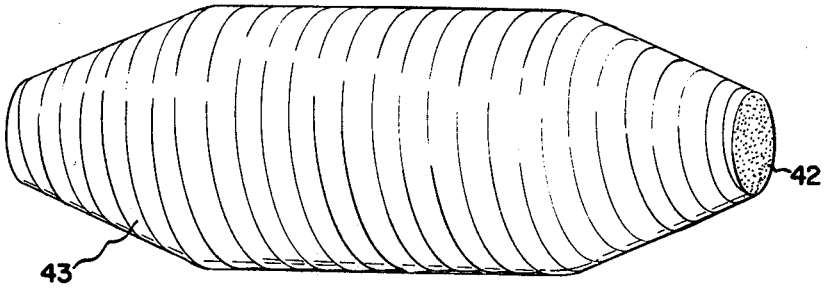
Fig. 8
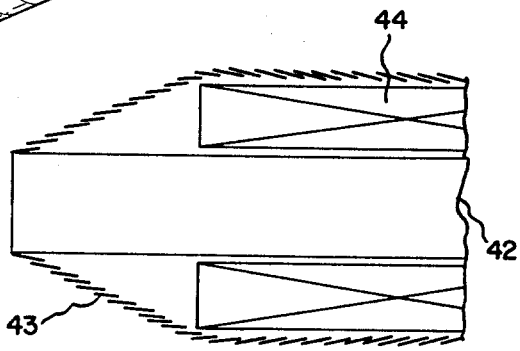
Fig. 9

AMORPHOUS METAL BALLASTS AND REACTORS

BACKGROUND OF THE INVENTION

This invention relates to lamp ballasts and to reactors for lighting and other applications that have magnetic cores of amorphous metal.

Special circuitry is required for the starting and running of fluorescent and mercury lamps from an alternating current supply. These lamps have a negative resistance characteristic which must be compensated by ballasting impedance, and the ballast also supplies higher or peaked voltage for starting and a regulated current for running. It is desirable that the current through the lamp be flat topped to increase the life of the lamp. A high reactance transformer or reactor is needed to meet the requirements of a good ballast, and a capacitor can be added to realize a leading power factor on the supply circuit. Conventional magnetic ballasts are made from steel lamination punchings and include magnetic shunts and cutaways to cause saturation, and reactors are constructed from punchings and have a precisely controlled air gap. The present configurations substitute an amorphous metal wound core for these laminations.

Amorphous metal is also known as metallic glass and exists in many different compositions including a variety of magnetic alloys. Typical compositions include one or more of the transition elements such as iron or nickel and one or more of the glass formers such as boron or phosphorous. Metallic glasses are made from metal alloys that can be quenched rapidly without crystallization, and these solids have unusual and in some cases outstanding physical properties. They are mechanically stiff, strong and ductile, and the ferromagnetic types have very low coercive forces and high permeabilities. For power applications amorphous metal core material has great promise because of the combination of low cost (potentially) and low magnetic losses; the core loss in amorphous metal is about one-fourth the loss found in the best silicon steel. Other considerations relevant to electronic and power frequency components are given in "Potential of Amorphous Alloys for Application in Magnetic Devices", F. E. Luborsky et al, Journal of Applied Physics, Vol. 49, No. 3 (Part II), March 1978, pp. 1769–1774.

Amorphous metal ribbon with a thickness of 2 mils or less is prepared by rapid quenching of a stream of molten metal on a rotating chill cylinder; the thickness limitation is set by the rate of heat transfer through the already solidified material, which must be rapid enough that the last increment of material to solidify still avoids crystallization. This is several times thinner than currently used lamination materials, but this is advantageous from the point of view of eddy current losses. The resistivity of amorphous metal is three times that of currently used materials which would also decrease the eddy current loss. The main object of this invention is to produce lower cost magnetic ballasts and reactor with a higher power efficiency.

SUMMARY OF THE INVENTION

Very thin amorphous metal strips are employed in magnetic structures configured to take advantage of the high resistivity and easy forming of these thin strips. Inductive devices such as ballasts and reactors are comprised of a pair of adjacent generally "O" shaped magnetic cores, each made of nested almost closed loops of amorphous metal strip without interlaminar insulation. The loop openings or gaps are in the center leg of the magnetic structure, on which one or more coils are assembled, and can be arranged in various ways to shape the lamp current waveform or control reactor inductance. The preferred embodiment of the lamp ballast utilizes gapped "O" cores, and the gap dimensions and shape, separation of the gap in one core from the gap in the other core, and location of the separated gaps under the secondary coil can be selected to simulate any type of cross section restriction desired. The portion of the core with a restricted area is saturated. Shunts made of stacks of amorphous metal ribbon may be retained in the coil windows of the cores between the two windings to decouple the primary and secondary if required; as an alternative the shunts are exterior to the core and parallel to their plane.

A lighting or general purpose reactor with a long slender configuration is constructed in like manner from two elongated "O" cores, but the gaps or openings between the almost complete loops of amorphous metal strip can be staggered to realize a given value of inductance. Another embodiment of a reactor has a long central core formed from compressed amorphous metal flake, and a helical wrapping or overwind of overlapped amorphous metal ribbon encloses the coil and contacts the core at both ends.

The magnetic alloy for these applications has a high ratio of remanent to saturation magnetization ($B_r/B_s$) exceeding 80 percent; i.e., the material has a relatively square hysteresis loop. One such alloy is $Fe_{82}B_{15}Si_3$. These inductive devices are characterized by low core losses, a long core suitable for many lamp ballasts, and a technique for obtaining a restricted core area to realize the proper flux nonlinearities.

BRIEF DESCRIPTION OF THE DRAWINGS

FIG. 1 is a perspective view of a typical prior art laminated steel ballast structure;

FIG. 2 shows an amorphous metal ballast having gapped "O" cores with shunts added if needed;

FIG. 3*a* is an expanded view of nested thin amorphous metal strips shaped to make gapped "O" cores, and FIG. 3*b* is an alternative method for fabricating these cores;

FIG. 4 is an end view of a ballast similar to that in FIG. 2 with an alternative configuration of the shunts;

FIG. 5 depicts a conventional reactor which has E-I steel laminations and a carefully defined air gap;

FIG. 6 shows an amorphous metal reactor that is long and slender and does not need the precise air gap control of the laminated structure;

FIG. 7 is an expanded view of the cores in FIG. 6 with staggered joints between the nested strips;

FIG. 8 illustrates another lighting reactor configuration characterized by a compressed amorphous metal core and an amorphous metal ribbon wrap; and FIG. 9 is a fragmentary cross section through FIG. 8.

DESCRIPTION OF THE PREFERRED EMBODIMENTS

The conventional laminated steel ballast structure in FIG. 1 is made of three stacks of laminations 10, 11, and 12 with the flux paths parallel to the plane of the laminations to reduce eddy current losses. The center leg of the three-legged core has an opening or restriction 13 which is placed under secondary coil 14 to give the proper magnetic flux non-linearities to secure a flat topped lamp current waveform. It is well known that this waveform improves operation and life of the lamp. The restriction may be round, square, oval, etc., and effects a reduction in the core cross section by a designated amount over a length l. The magnetic material at the restricted area of the core is saturated during a portion of the sinusoidal ac supply voltage impressed on primary coil 15. The relation between the shape of the restriction and its effect on the secondary magnetic circuit is complex, but it is seen that a long restriction (large l) saturates a long length of the center leg and for high flux densities builds a large leakage reactance into the secondary circuit, while a narrow restriction (small l) saturates a short length and for high flux densities builds a small leakage reactance into the secondary. Also, a square or rectangular restriction results in a sharp knee in the magnetization curve (B vs. H) for the material of the core, and a circular restriction results in a rounded knee on the magnetization curve. The location of the restriction under the secondary coil, closer to one end or the center, can be varied. Shunts 16 perpendicular to the lamination plane are added, if needed, to decouple the primary and secondary in the event the necessary leakage reactance cannot be obtained by geometry alone.

Very thin amorphous metal strips (2 mils or less in thickness) are employed in analogous configurations which take advantage of the high resistivity and easy forming of these very thin strips. The lamp ballast in FIG. 2 has low core losses because of high material resistivity, a long core suitable for many lamp ballasting applications, a way of obtaining the restricted area to provide proper non-linearities, and two ways of adding magnetic or non-magnetic shunts to secure proper leakage reactance and low mechanical noise. The magnetic structure is comprised of a pair of gapped "O" cores 20 and 21 which are assembled together in the same plane with their long sides adjacent to one another to form a three-legged laminated structure 22. Assuming a uniform strip width, the cross section of the center leg is then exactly twice that of the outer legs and core ends. Each elongated core is made of nested or concentric almost closed loops of amorphous metal strip 23 having loop openings approximately aligned to define a magnetic circuit air gap. The almost closed loops of ribbon material may also be referred to as almost complete "O" strips. Gap 24 in core 20 and gap 25 in core 21 are both in the center leg under secondary coil 26 but are separated from one another to provide a continuous path for magnetic flux through the amorphous metal. Shunt packages 27 and 28 are provided when needed and are retained in the coil windows between secondary coil 26 and primary coil 29.

Two constructions of the gapped "O" cores and techniques for their fabrication are illustrated in FIGS. 3*a* and 3*b* to expanded scale. In the former, core 20 has individual laminations made of flat continuous amorphous metal tape 23 of uniform width bent into a long, rectangular loop with the tape ends directly opposite one another separated by the gap length $g_1$. The nested laminations are directly in contact and interlaminar insulation is not required, resulting in an improved space factor. Core 21 has a gap $g_2$ located along the long core side at a different position than is gap $g_1$. Upon assembly of the two cores with the long sides in engagement, the gaps have a separation s, and length l′ is defined as the distance from one end of gap $g_1$ to the other end of gap $g_2$ and corresponds to restriction length l in FIG. 1. Gap lengths $g_1$ and $g_2$, their separation s, and the location of the separated gaps under the secondary core can be varied to realize a desired core cross section reduction. The amorphous metal loop ends are normally lined up and the gap has a constant length, and it is also possible to have jagged or zig-zag ends and to shape the gap. Lined up ends tends to give a sharp knee on the magnetization curve and jagged ends give a rounded knee. Speaking generally, the gap dimensions and shape, separation of the gap in one core from the gap in the other core, and location of the separated gaps under the secondary coil can be selected to simulate any type of cross section restriction. Heuristic methods are employed to fine tune the final configuration for a particular application.

Gapped "O" cores 20′ and 21′ in FIG. 3*b* are fabricated by winding a long length of amorphous metal ribbon as a spool of tape is wound, and then cutting through the wound core afterwards with a laser beam to provide the gap. Apparatus used for laser welding or for electron beam welding can be employed. In this case, the gap has a constant length with the difference that the laminations are welded together, giving the core greater mechanical strength. A common size of ballast for two 40-watt fluorescent lamps is made from ribbon about 0.7 inches wide, and the overall length of the three-legged laminated structure is in excess of three times its width. This ballast configuration can be manufactured at low cost, and automatic bobbin winding of the coils is possible. The high reactance ballast transformer is a loosely coupled magnetic circuit with the primary and secondary wound on different parts of the core. The wound core, because of the loose magnetic coupling, can be coil-wound using the approach or a variation thereof described in U.S. Pat. No. 4,060,783 to J. D. Harnden, Jr. A hemispherical jig on either side of the core supports a coil form or bobbin which is driven by a friction clutch or by gearing. The coil is wound automatically by rotating the coil form while holding the core and hemispherical jigs stationary. Alternatively, the coils and "O" cores can be assembled together by separately winding the coils on bobbins followed by automatic mechanical insertion of a stack of step formed amorphous metal strips into the coil package using an existing machine. This means reduction of factory investment for lamination and assembly operations.

Referring to FIG. 2, shunts 27 and 28 are made of stacks of amorphous metal ribbon which are retained in the coil windows between the center leg and outer leg of each core, in the space between primary coil 29 and secondary coil 26. The shunt packages may be glued in place with the provision that the glue that is chosen must be thermoset and have a high modulus of elasticity. Under secondary short circuit conditions, shunts 27 and 28 provide an alternate and predictable path for magnetic flux between the primary and secondary. Shunts are not always essential to a ballast but are often added to secure the proper performance. Another way of adding shunts to the ballast depicted in FIG. 4 is that shunt packages 30 and 31 of amorphous metal ribbon are exterior to and parallel to the plane of "O" cores 20 and 21 in between the primary and secondary windings. The length of shunts 30 and 31 is approximately equal to the overall width of the magnetic structure.

The amorphous metal magnetic alloy needed for ballast and reactor applications has a high ratio of remanent-to-saturation magnetization, i.e., $B_r/B_s$ is greater than 80 percent, where $B_r$ is the remanent induction and $B_s$ is the saturation or maximum induction. A core material of this type has a relatively square hysteresis loop. One such alloy is $Fe_{82}B_{15}Si_3$, for which $B_r/B_s=90$ percent. The $Fe_{80}B_{20}$ alloy, with $B_r/B_s=68$ percent, is not as promising a material at present unless further developed.

The conventional reactor ballast structure shown in FIG. 5 has E-I steel laminations 33 and 34 and a carefully and precisely defined air gap 35 at the top of the center leg. The coil is indicated at 36. An analogous configuration has E-∃ laminations, and the gap is halfway down the center leg. Lighting reactors for home use in the United States are in series with the lamp and starter without an associated capacitor but in Europe on 220 volt circuits a capacitor is often placed across the line.

The amorphous metal lighting or general purpose power reactor in FIG. 6 is built from two relatively long "O" magnetic cores 37 and 38 assembled coplanar with one another as in FIG. 2. Amorphous metal strips 39 (see FIG. 7) are bent into a long, almost closed loop with the ends separated by a gap 40, but the openings or gaps in the nested almost complete "O" strips are staggered along the long core side under coil 41. The overall length of the core is greater than four times the overall width, but the cores can be shorter when the gapped "O" cores of FIG. 3*a* or 3*b* are employed in the reactor; in any case, the loop openings whether staggered or not are arranged to attain a given value of inductance. The high resistivity of the amorphous metal allows substantially more flux to go across the air gap than would have been expected from the identifical configuration with thin silicon iron strips. This effect makes possible the construction of a reactor which is long and slender and does not need to have the precise air gap control of the laminated structure. Staggered openings or joints are preferred because there is then less stray flux. These cores can be made from one-half inch amorphous metal ribbon.

Another embodiment of a reactor with a long slim profile is shown in FIG. 8. A central cylindrical core 42 is constructed of compressed amorphous metal flake, or chips of amorphous metal, with or without a binder, as taught for instance in copending application Ser. No. 954,197 filed on Oct. 24, 1978, "Molded Amorphous Metal Electrical Magnetic Components", P. G. Frischmann, assigned to the same assignee as this invention. Core 42 can also be fabricated by twisting together long narrow ribbons of amorphous metal much as cable is made, or can be formed from conventional magnetic materials. A helical wrapping 43 of overlapped amorphous metal ribbon, about one-half inch wide or less, encloses coil 44 and, as shown in FIG. 9, is tapered at either end and contacts the surface of the core so that the overwrapping and core are a closed magnetic circuit. Despite the thinness of the amorphous metal ribbon, one or two layers of over-wrap is sufficient to comply with the usual requirement that the area of the over-wrap is at least 80 percent to 90 percent of the cross-sectional area of the core. Magnetic flux perpendicular to the plane of the ribbon is permissible in this reactor configuration and does not produce unacceptable losses. This reactor is of interest to produce very low profile fixtures for small single lamp fluorescent fixtures or as a slim rod-like ballast for a circular fluorescent lamp.

Ballasts for high intensity discharge (HID) lamps require lower coupling coefficients and are typically made with hollow square cores. The method of construction described for the lamp ballast in FIGS. 2–4 can be employed for these, although the advantages may be less pronounced. Both lamp ballast embodiments can be constructed with gapped generally "O" shaped cores with the restricted core area tailored obtain the proper flux non-linearities. These amorphous metal ballasts may or may not have capacitors, and the latter are extensively described in prior art patents such as U.S. Pat. No. 2,958,806 to H. W. Lord. Ordinarily, the amorphous metal "O" cores have a defined gap, but an exception is a lag ballast with no capacitor in the secondary circuit where the gap is very small or is the opening between butted together ends of "O" strips of amorphous metal ribbon. The function of the restricted core section to cause saturation and shape the lamp current waveform has been mentioned. As is known in the art, saturation causes a pulse condition which initiates starting of the lamp, causes a voltage regulation condition which filters out transitory voltage waves in the line, and shapes the current waveform for optimum lamp efficiency. The present ballasts when properly designed have the same performance. In addition they have low core losses and are efficient, and are ecnomical to manufacture considering that there is no scrap (laminations punched from steel strip generate considerable scrap).

While the invention has been particularly shown and described with reference to several preferred embodiments thereof, it will be understood by those skilled in the art that the foregoing and other changes in form and details may be made therein without departing from the spirit and scope of the invention.

The invention claimed is:

1. An amorphous metal inductive device for ballast and reactor applications comprising a pair of coplanar generally "O" shaped magnetic cores, each constructed of nested almost closed loops of amorphous metal strip having loop openings located along one core side, the core sides with such openings being adjacent to and in contact with one another to be the center leg of a magnetic structure, said amorphous metal loop openings in each core are aligned to define a constant gap of predetermined length, the gap in one core being separated from the gap in the other core, and at least one coil mounted on said center leg magnetically coupled with said cores.

2. The inductive device of claim 1 wherein said amorphous metal strips have a uniform width and are made of a magnetic alloy with a $B_r/B_s$ ratio exceeding 80 percent.

3. An amorphous metal lamp ballast comprising a pair of elongated gapped "O" cores each constructed of nested flat continuous strips of amorphous metal bent into an almost closed loop with the loop openings defining a gap of designated dimensions, said cores being adjacent to and in contact with one another in the same plane to provide a center leg with a substantially greater cross sectional area than other core legs and ends and with the gap dimensions and separation between gaps in the two cores selected to shape the lamp current waveform, and primary and secondary coils mounted on said center leg with said secondary coil overlying the separated gaps and both coils magnetically coupled with said cores.

4. The ballast of claim 3 wherein, in each core, the amorphous metal loop openings are approximately aligned to establish a gap of uniform length.

5. The ballast of claim 3 or claim 4 wherein the amorphous metal is the $Fe_{82}B_{15}Si_3$ alloy.

6. The ballast of claim 3 wherein, in each core, the amorphous metal loop ends are aligned to establish a gap having jagged edges.

* * * * *

UNITED STATES PATENT AND TRADEMARK OFFICE

CERTIFICATE OF CORRECTION

PATENT NO. : 4,288,773

DATED : September 8, 1981

INVENTOR(S) : Robert P. Alley et al

It is certified that error appears in the above-identified patent and that said Letters Patent is hereby corrected as shown below:

The title page should appear as shown on the the attached sheet.

Signed and Sealed this

*Seventh* Day of *June 1983*

[SEAL]

*Attest:*

DONALD J. QUIGG

*Attesting Officer*

*Acting Commissioner of Patents and Trademarks*

United States Patent [19]

Alley et al.

[11] 4,288,773

[45] Sep. 8, 1981

[54] AMORPHOUS METAL BALLASTS AND REACTORS

[75] Inventors: Robert P. Alley, Manlius; Russell E. Tompkins, Scotia, both of N.Y.

[73] Assignee: General Electric Company, Schenectady, N.Y.

[21] Appl. No.: 966,855

[22] Filed: Dec. 6, 1978

[51] Int. Cl.[3] ..... H01F 17/06; H01F 71/08; H01F 77/24

[52] U.S. Cl. ..... 336/160; 336/83; 336/165; 336/178; 336/211

[58] Field of Search ..... 336/155, 160, 165, 178, 336/211, 83, 212; 164/260; 148/31.55; 310/114

[56] References Cited

U.S. PATENT DOCUMENTS

| | | | |
|---|---|---|---|
| 2,792,556 | 5/1957 | Oglesbee | 336/155 |
| 2,958,806 | 11/1960 | Lord | 336/165 X |
| 2,962,679 | 11/1960 | Stratton | 336/83 |
| 2,971,124 | 2/1961 | Feinberg et al. | 336/165 X |
| 3,072,826 | 1/1963 | Schwarz et al. | 336/165 X |
| 3,111,637 | 11/1963 | Ouletta | 336/178 X |
| 3,176,253 | 3/1965 | Radtke | 336/165 |
| 3,708,744 | 1/1973 | Stephens et al. | 336/155 X |
| 4,036,638 | 7/1977 | Ray et al. | 148/31.55 X |
| 4,116,728 | 9/1978 | Becker et al. | 336/213 X |
| 4,197,146 | 4/1980 | Frischmann | 148/31.55 |

*Primary Examiner*—Thomas J. Kozma

*Attorney, Agent, or Firm*—William H. Steinberg; James C. Davis, Jr.; Paul R. Webb, II

[57] ABSTRACT

A lamp ballast has a pair of adjacent gapped "O" magnetic cores made of nested, almost complete loops of amorphous metal strip with the gaps in the loops shaped and arranged under the secondary coil to simulate any type of restricted cross section for shaping the lamp current. A long slender reactor has a similar configuration in which the gaps are staggered; a different embodiment has a long central core of compressed amorphous metal flake and a helical overwrap of ribbon. An alloy of iron, boron, and silicon with a high $B_r/B_s$ ratio is preferred for these inductive devices.

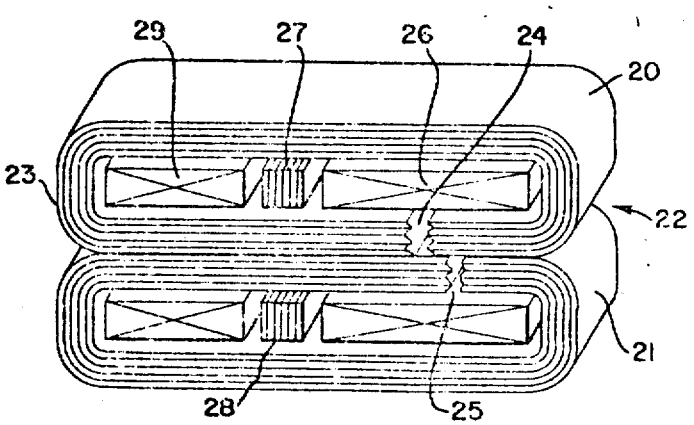

6 Claims, 10 Drawing Figures